US010755521B1

(12) United States Patent
Hamman et al.

(10) Patent No.: US 10,755,521 B1
(45) Date of Patent: Aug. 25, 2020

(54) METHOD AND SYSTEM FOR ENABLING VARIABLE WAGERS ON A COMMON DRAWING VIA ASSIGNED BINS WHILE USING A SINGLE DRAW GAME TICKET FOR MAKING A PLURALITY OF WAGERS

(71) Applicant: SCA Promotions, Inc., Dallas, TX (US)

(72) Inventors: Robert D. Hamman, Dallas, TX (US); Kenneth E. Irwin, Jr., Dawsonville, GA (US)

(73) Assignee: SCA Promotions, Inc., Dallas, TX (US)

( * ) Notice: Subject to any disclaimer, the term of this patent is extended or adjusted under 35 U.S.C. 154(b) by 0 days.

(21) Appl. No.: 16/749,315

(22) Filed: Jan. 22, 2020

(51) Int. Cl.
*G07F 17/32* (2006.01)

(52) U.S. Cl.
CPC ..... *G07F 17/3227* (2013.01); *G07F 17/329* (2013.01); *G07F 17/3244* (2013.01)

(58) Field of Classification Search
CPC . G07F 17/3227; G07F 17/3244; G07F 17/329
USPC ..... 463/17
See application file for complete search history.

(56) References Cited

U.S. PATENT DOCUMENTS 5,938,196 A 8/1999 Antoja
6,234,478 B1 5/2001 Smith
7,883,409 B2 * 2/2011 Little ..... G07F 17/3239 463/25
8,662,998 B2 3/2014 Schueller
8,747,209 B2 6/2014 Badrieh
9,472,047 B2 10/2016 Hilbert et al.
9,687,740 B1 6/2017 Grubmueller, Jr.
10,424,152 B1 9/2019 Hamman et al.
2003/0050109 A1 3/2003 Caro et al.
2004/0058726 A1 * 3/2004 Klugman ..... G07F 17/32 463/17
2008/0146323 A1 6/2008 Hardy et al.
2009/0131132 A1 5/2009 Kohls et al.
2009/0227320 A1 9/2009 McBride
2010/0029376 A1 2/2010 Hardy et al.
2010/0222136 A1 9/2010 Goto et al.
2011/0092267 A1 * 4/2011 Hardy ..... G07F 17/329 463/17
2011/0275438 A9 11/2011 Hardy et al.
2011/0281629 A1 11/2011 Meyer
2013/0244745 A1 9/2013 Guziel et al.
2014/0094256 A1 4/2014 Hilbert et al.
2014/0106866 A1 4/2014 Hardy et al.
2016/0232750 A1 8/2016 Hardy et al.

* cited by examiner

*Primary Examiner* — Allen Chan
(74) *Attorney, Agent, or Firm* — Panitch Schwarze Belisario & Nadel LLP

(57) ABSTRACT

A method and system are provided for betting and redemption using a single draw game ticket for a plurality of discrete wagers made by an individual consumer for a given draw game, thereby allowing discrete wagers to be accepted, recorded, and documented for any number of wagers at one time.

20 Claims, 11 Drawing Sheets

START

↓

500 – Create *n* number of virtual bins of at least one size to be mathematically compatible with the desired odds and corresponding payout

↓

502 – Generate the corresponding modulo number such that there is one unique modulo pointer position in each of the *n* virtual bins

↓

504 – Save the *n* number of virtual bins and congruence numbers

↓

506 – Record consumer selections of odds or payouts for universal draw game tickets purchased by the consumers

↓

508 – Assign unique serial numbers to the purchased universal draw game tickets, and save for each of the purchased universal draw game tickets (i) the unique serial numbers, (ii) the corresponding consumer selected odds or payouts, and (iii) associated modulo numbers

↓

510 – After the universal draw game has been concluded, validate the purchased universal draw game tickets against the universal draw game result

↓

END

FIG. 5

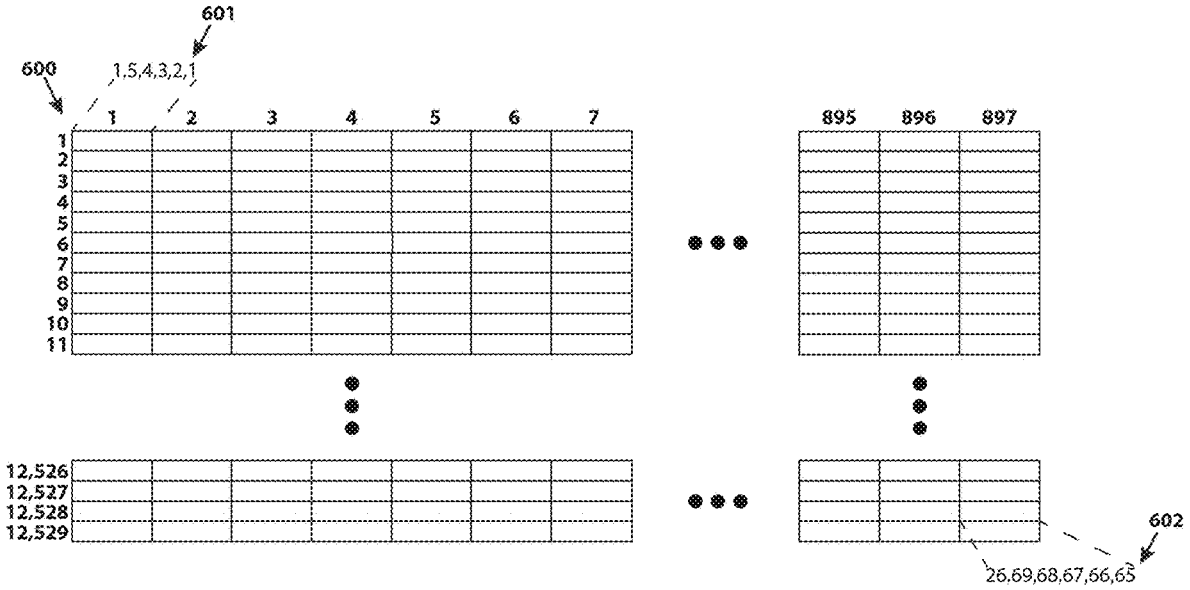
603
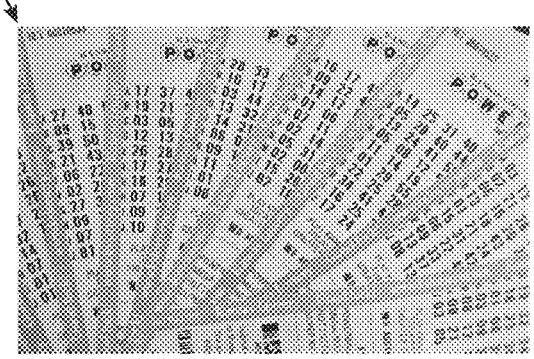
100 Plays Prior Art PowerBall Bet Tickets
604
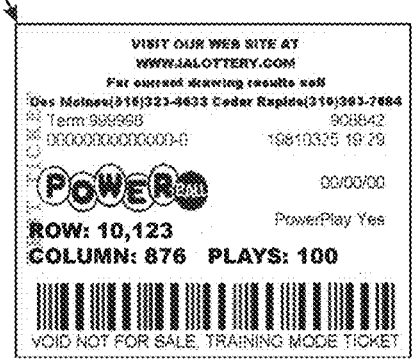
100 Plays Disclosed PowerBall Bet Ticket
FIG. 6A

START

↓

700 — Create a virtual bin having a size that is mathematically compatible with the given draw game, the virtual bin being populated with a series of different cells containing respective congruence numbers, the virtual bin including row and column numbers which allow for specifying one cell location within the virtual bin

↓

702 — Save the virtual bin, and its cells, and respective congruence numbers, into memory on a draw game system central site database

↓

704 — Select row and column numbers of the virtual bin that specifies (i) one cell location within the virtual bin for one of the plurality of discrete wagers made by the individual consumer for the given draw game, the one cell location having a specified row and column number, and (ii) additional cell locations within the virtual bin for the remaining discrete wagers made by the individual consumer for the given draw game, each of the additional cell locations having a respective specified row and column number, the additional cell locations being annexed from a number of adjacent cells in the same row corresponding to the number of remaining discrete wagers

↓

706 — Record, in the memory on the draw game system central site database, the one cell location within the virtual bin and the additional cell locations within the virtual bin for the plurality of discrete wagers made by the individual consumer for the given draw game

↓

708 — Generate a single draw game ticket that documents the pending wager and which identifies the number of the plurality of discrete wagers, thereby finalizing the pending wager, the single draw game ticket including a unique serial number that is linked to the recorded cell locations within the virtual bin for the plurality of discrete wagers made by the individual consumer for the given draw game

↓

END

FIG. 7

METHOD AND SYSTEM FOR ENABLING VARIABLE WAGERS ON A COMMON DRAWING VIA ASSIGNED BINS WHILE USING A SINGLE DRAW GAME TICKET FOR MAKING A PLURALITY OF WAGERS

BACKGROUND OF THE INVENTION

1. Field of the Invention

The present invention relates to a system and method for allowing a plurality of consumers to each select his or her own fixed odds and associated payoff (assuming the wager wins) from a common universal drawing by subdividing one drawing event into a series of variable sized "bins" that reduce wagered odds to a subset of the greater overall odds of the universal drawing. This reduction in wagered odds (i.e., greater chance of winning from a consumer's perspective) is achieved by creating a plurality of bins each containing a portion of the possible universal drawing outcomes, the totality of bins thereby containing 100% of the possible drawing outcomes. Additionally, a modulo operation is performed to create a unique pointer for each of the previously created bins. Thus, any desired subset of reduced wagering odds can be achieved with the virtual creation of the corresponding number of bins. This system creates new flexible wagering to allow consumers to fine tune their wagers to whatever risk and reward potential payoffs they desire, thereby greatly enhancing the marketability and desirability of "standard" draw games. In another related embodiment, the previously disclosed variable sized "bins" may also be utilized to provide a matrix basis for selecting and recording varying quantities of "quick pick" wagers.

2. Background

Typically, a draw game is a form of gambling that involves wagering on a future drawing of numbers or other indicia in "lots" for a prize. The history of draw games can be traced back thousands of years. By most accounts, draw games originated in China with a game that is now known as "Keno" that was utilized by the state to raise funds for the construction of the Great Wall of China.

Most modern lottery draw games allow consumers to purchase tickets for future drawings with prizes ranging from fixed cash awards to forms of parimutuel or "parimutuality" (i.e., where the allocated portion of winnings are equally shared among all winners of a particular level) payouts. While lotteries and other gaming venues typically allow consumers to choose their own numbers or other indicia, a substantial majority of consumers make wagers via "quick picks"—e.g., allowing a random or pseudorandom number generator to select the wager numbers automatically for a consumer. One possible reason for the consumer's preference for quick picks is that (since it is unlikely that two people will receive the same "random" numbers) the possibility of multiple winners for the same drawing is presumably less, whereas "parimutuality" type draw games inherently can result in the undesirable consequence of a large number of winners for any given drawing, resulting in each winner realizing a significantly reduced prize.

This problem of wagering for a draw game prize where the prize return is uncertain at the time of wager is endemic with most large draw game prizes. For example, if the "parimutuality" game Powerball® realized sales of $100,000,000 with a 50% prize fund and only one ticket had the winning numbers for a given drawing, the ticket holder would be awarded a prize valued at $50,000,000. However, with the same Powerball sales of $100,000,000 and 50% prize fund, if there were two winning tickets for the same drawing, each ticket holder would only receive $25,000,000 instead of the $50,000,000 prize award with a single winner. This reduction in individual player winnings would continue as more winning tickets were identified for a given drawing.

Aside from the problem of potentially varying prize payouts, the classical fixed number of outcomes for a given draw game type dictate various prize tiers that may not be appealing to all types of consumers. For example, assume three different draw games, all with different wager types, all with 100% payouts, and all where each wager costs $1. Thus, the three exemplary draw games could be:

a 1 in 10,000 chance of winning $10,000
a 1 in 100 chance of winning $100
or, a 1 in 2 chance of winning $2

In this example, most people would play the long odds game of "1 in 10,000 chance of winning $10,000." However, if the same three draw games with 100% payout were played where each wager now cost $100 (i.e., a 1 in 10,000 chance of winning $1,000,000; a 1 in 100 chance of winning $10,000; or a 1 in 2 chance of winning $200) most people would probably play the short odds game of "1 in 2 chance of winning $200." The difference being that for most people the pain of losing $100 is greater than losing $1. Thus, concepts like "price point", "payout", and "hit frequency" translate to consumers feeling both satisfaction and pain—or, to put it another way, no existing draw game can work for all consumers because every consumer does not feel satisfaction and pain the same way.

In addition to the problem of variable odds for a given draw game, recently large shared betting pool alliances have emerged with multiple consumers all contributing to a general draw game pool fund where a large plurality of individual wagers are made by the alliance at one time, thereby creating logistical problems by accepting, recording, and documenting the numerous wagers in a single event. The resulting series of multiple payable on demand bet tickets generated by these shared betting pool alliances is problematic for both the lottery retailer as well as the alliance itself.

Some notable attempts have been made to introduce variable odds and payouts into various gambling games—e.g., U.S. Pat. No. 5,938,196 (Antoja); U.S. Pat. No. 6,234,478 (Smith); U.S. Pat. No. 8,662,998 (Schueller); and U.S. Pat. No. 9,687,740 (Grubmueller). However, Antoja simply teaches implementing slot machine adjustable pay schedules with a predictable payout (column 2, lines 8 through 11) and is therefore limited in its applicability to most draw games as well as its restricted pay schedules enabling only a small amount of variability. These same basic concepts are taught in a different, game dial, embodiment in Smith with consequently the same disadvantages. Schueller teaches the same general concept with the embodiment of electronically swapping various "assets" that in some embodiments can include pay schedules or tables; thereby offering greater variety, but with limited applicability to draw games in general. Finally, while Grubmueller does specifically addresses draw games, the adjustability and variability of Grubmueller is achieved with the inclusion of "side events" that are linked to a "main event" or drawing. Therefore, with Grubmueller the odds, flexibility, and payout of the "main event" draw game remains unaltered with only "side events"

or bets offering variability. Thus, the prior art is largely silent on how to introduce variable odds, flexibility, and payouts to a single draw game event.

Prior art related to providing fixed assured payouts with parimutuel wagering systems tend to be focused on horse race tracks (e.g., U.S. Patent Application Publication No. 2009/0131132 (Kohls et al.). However, horse race tracks are relatively small networks where delivering parimutuel odds and other data in real time or near rear time does not pose any significant computational challenge, with the actual payouts being available in real time at the time of the wager. In contrast, lottery related draw game systems prior art tends to exclusively focus on new types of games and the systems to support them with no regard to enabling fixed payouts at the time of wagering and/or variable odds, flexibility, and payouts to a single draw game event—e.g., U.S. Patent Application Publication Nos. 2003/0050109 (Caro et al.); 2004/0058726 (Klugman); 2009/0131132 (Kohls et al.); 2009/0227320 (McBride); 2010/0222136 (Goto et al.); 2011/0281629 (Meyer); 2013/0244745 (Guziel et al.); and U.S. Pat. No. 8,747,209 (Badrich).

Therefore, in order to enhance the appeal of draw games to a broader market base, it is highly desirable to develop draw game systems where prize payouts are known at the time of the wager where a consumer or other entity can select his or her desired odds and payout. Ideally, these draw game systems are game type independent, thereby offering the greatest utility to lotteries and other draw game system providers.

SUMMARY OF THE INVENTION

Objects and advantages of the present invention will be set forth in part in the following description, or may be obvious from the description, or may be learned through practice of the present invention.

A method and system are provided for variable and flexible draw game systems utilizing computer hardware. The variability and flexibility of the present invention is principally derived by subdividing one universal drawing event into a series of variable sized "bins" that reduce wagered odds to a subset of the greater odds of the universal drawing. This reduction in wagered odds (i.e., greater chance of winning from a consumer's perspective) is achieved by creating a plurality of bins, each containing a portion of the possible universal drawing outcomes, the totality of bins thereby containing 100% of the possible drawing outcomes. Once the correct number of bins required to achieve the desired odds and associated payout is created, a consumer selects or is assigned a number (modulo) and bin size required to provide the desired odds and payout. A modulo operation is then performed to create a series of pointers, one or more pointer(s) for each of the created bins. Each pointer thereby selects at least one unique draw bet number in each bin, the totality of the selected draw bet numbers from all the bins constituting the consumer's wager for the universal drawing. Thus, by varying the number of bins and/or the modulus, a substantial plurality of variable wager odds and corresponding prize payouts can be achieved so long as the selected odds are less than the overall odds for the universal drawing.

Whenever a wager is made, the selected or assigned modulo number is printed on the wager ticket receipt along with the selected payout. When the drawing occurs, the associated winning modulo number for each prize payout level can be posted, thereby allowing consumers to easily determine if their particular wager won a prize by simply looking up their prize payout level and seeing if their printed wager number matched the winning number for that prize payout.

Described are mechanisms, systems, and methodologies related to constructing variable odds draw game systems utilizing computer hardware thereby enabling methods of inexpensive operation enabling hitherto unknown variable and flexible betting formats from a common universal draw game. The key innovations are the division of all possible outcomes into a series of n bins as well as assignments of corresponding numbers and moduli at the time a wager is made, thereby enabling high-speed variable and flexible betting.

In a general embodiment, a draw game system is disclosed that provides consumer selectable varying odds and payouts in real time that are not available via prior art systems. The variability and flexibility of the present invention is achieved from determining the desired bin size and corresponding number and modulus for the desired odds at the time of wager. After the drawing occurs, the redemption system utilizes the stored bin sizes as well as the associated moduli numbers from all wagers to determine the appropriate winners (if any) for the single universal drawing.

As an inherent aspect of this general embodiment, the disclosed variable and flexible draw game system architecture readily accommodates ergonomic consumer redemption by displaying the wager number that was assigned to the bet at the time of the wager on the draw game paper ticket or digital embodiment. This displayed number can be verified against posted winning modulo numbers for the odds wagered. This is possible because there is only one winning number and modulo for each set of odds. Thus, the consumer only needs to know his or her number to determine if the wager was a winner. Alternatively, a consumer would have to check their millions, billions, trillions, etc. of numbers wagered to determine if any one matched the universal draw number.

This inherent aspect of the saved modulo for each bet determining the winner further expedites the drawing settlement process—i.e., after sales for a particular draw game are closed and the winning sequence of numbers is determined. After the drawing process is completed, the relatively trivial calculations needed to determine a winner with each set of bet odds allows winning tickets to be settled almost immediately.

In a specific embodiment, the draw game system enabled by the present invention provides can provide fixed (i.e., guaranteed) payout values at the time of wager for vast pluralities of odds instead of approximate amounts typical of parimutuel or "parimutuality" draw games. These fixed payout values are sustainable since a common Expected Value (EV) is maintained across all bet odds.

In another specific embodiment, the variable draw game system supports consumer selectable modulo numbers from a given range. These consumers selectable modulo numbers can be in the form of direct selection or the result of a game (e.g., virtual digital rotary wheel).

In an alternative embodiment, the variable and flexible draw game system is configured to provide a flexible progressive type wagering opportunity where the plurality of virtual bins remains static over a plurality of universal drawings. Thus, subsets of matching numbers or other indicia from the plurality of universal drawings can be specified such that once a predetermined threshold of matching number subsets is achieved for an individual consumer, a prize is awarded. Since there will be an uncertain number of universal drawing iterations until the prize is awarded, the progressive jackpot will increase each time a universal drawing is played and the jackpot is not won. When the progressive jackpot is won, the jackpot for the next play is reset to a predetermined value, and resumes increasing under the same method.

In another alternative embodiment, the variable and flexible draw game system is configured to provide a method for pseudorandomly selecting "quick pick" bets for any large plurality of draw game wagers submitted at the same time. This method enabling both rapid wagering for any number of bets as well as a concise and efficient system for recording and documenting the wagers, with both electronic and payable on demand documents.

Described are a number of mechanisms and methodologies that provide practical details for reliably developing a variable and flexible draw game system from commonly available (i.e., low cost) hardware that also provides for scalability. Although the examples provided herein are primarily related to lottery draw games, it is clear that the same methods are applicable to any type of wagering system where a large number of possible outcomes are possible.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 2A-2 is a front elevation representative example of a variable draw game betting human interface where the consumer selects the odds that is compatible with the present invention;

FIG. 5 is a flowchart of one preferred embodiment of the present invention;

FIG. 6A is a representative example diagram defining the plurality bin assignments at the time of a wager for a variable draw game system to select and record a plurality of wagers for an exemplary Powerball game as enabled by one preferred embodiment of the present invention;

FIG. 7 is a flowchart of one preferred embodiment of the present invention shown in FIGS. 6A and 6B.

DETAILED DESCRIPTION OF THE INVENTION

Figure 1A:
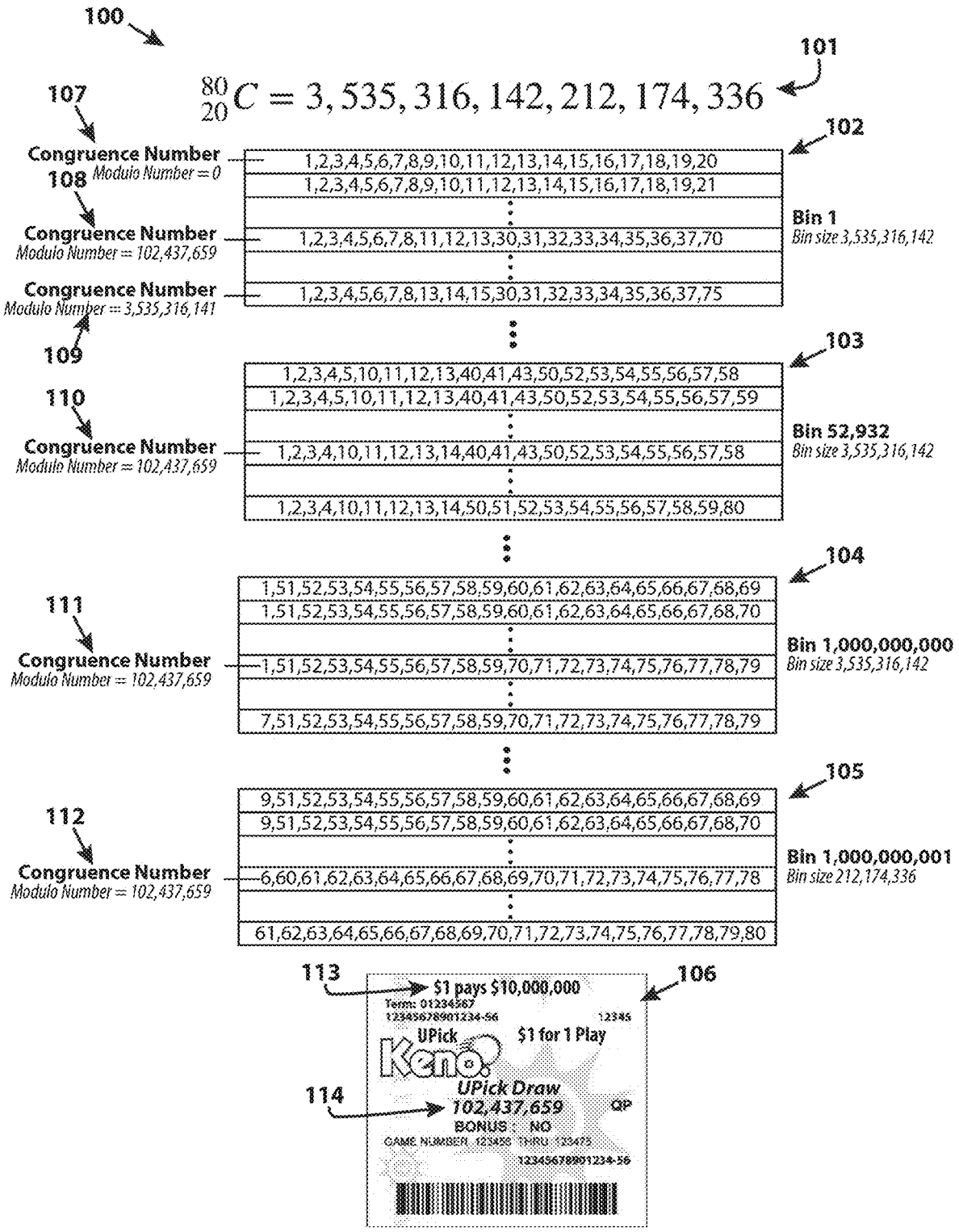
FIG. 1A is a representative example diagram defining the plurality bin and modulo number assignments at the time of a wager for a variable draw game system embodiment as enabled by the present invention.

Certain terminology is used herein for convenience only and is not to be taken as a limitation on the present invention. The words "a" and "an", as used in the claims and in the corresponding portions of the specification, mean "at least one." In the context of the present invention, the term "parimutuality" refers to a lottery type draw game where bets are placed on an outcome, the payout per winner is determined by the sum of all bets (less the house take), and the potential payout is known only approximately at the time the wager is made. In contrast, in a true parimutuel game (e.g., horse race, greyhound racing, jai alai, sporting events with ranked outcomes), the winning amounts would still be determined by the money wagered; however, the exact payout would be known to the consumer at the time of the wager with the payout being principally determined by the total amount of money already wagered and how the wagers are distributed among potential outcomes. A "wager" or "bet" as used interchangeably in the claims and in the corresponding portions of the specification means a gamble on predicting the outcome of a drawing in the future. When discussing "wagers" or "bets", for brevity, both the specification and the claims describe the wager or bet in terms of "numbers"; however, in the context of this disclosure, it is defined that the term "numbers" may also include other draw game indicia (e.g., play cards, letters, lucky symbols). Additionally, the term "draw game" refers to a wager made for some drawing in the future. As a practical matter, this future drawing can be a ping-pong draw machine, a Random Number Generator (RNG), a slot machine "pull," or the like.

In the context of the present invention, a "bin" is a virtual subset of all possible outcomes from a drawing, with each outcome in each "bin" associated with its own unique modulo pointer. Therefore, the set of all "bins" would contain all possible outcomes for a given drawing. The number of virtual "bins" assigned for a drawing varying by the desired odds and payouts. Finally, the term "congruence number" as used in the claims and in the corresponding portions of the specification, is defined as the number embodied in each bin location specified by a given modulo pointer. The "congruence numbers" thereby designate the set of numbers or other indicia wagered in a specific drawing's outcome.

Before describing the present invention, it may be useful to first provide a brief description of the current state of the art of draw game execution and validation as well as the various types of consumers that are attracted to different types of draw games. The concept is to ensure that a common lexicon is established of existing systems prior to describing the present invention.

Typical lottery style draw games include Pick 3, Pick 4, Mega Millions®, Powerball, and Keno. Other types of draw games include raffles, slot machines, Bingo, and horse races. The key concept is a wager is made in advance betting on the outcome of some drawing in the future. In all prior art embodiments, there is some protocol or system (e.g., lottery terminal and central site, paper raffle ticket, Bingo card, Keno draw game ticket) that essentially records the bet, thereby locking the wager in advance of the actual drawing. Typically, drawings are based on a fix set of possible numbers or other indicia where some subset of numbers or other indicia are selected (or "drawn") through a random or pseudorandom process in a future "drawing." Therefore, since typical prior art draw games involve selecting a subset of numbers or indicia from a larger set, the probability and odds are defined by the laws of mathematics. Thus, changing the odds and corresponding payoff requires changing the fix set of numbers or indicia to be drawn and/or the subset of numbers or other indicia that are selected.

However, different types of consumers prefer different types of draw games, usually equating to some function of "price point," "payout," and "hit frequency." Stereotypically, this equates to four different kinds of generic consumers:

"Grind" consumers: prefer frequent chances to win—e.g., "Pick 3"

"Punters": prefer medium or larger wins—e.g., "Fantasy 5"

"Discovery" consumers: prefer unique features and are often focused on mid-payouts e.g., "Keno"

"Jackpot" consumers: prefer games that include very large, typically unattainable payouts—e.g., "Powerball"

Simply put, no prior art draw game can work for all consumers, because every consumer does not prefer the same types of odds and hit frequency. The prior art draw games odds and hit frequency are driven by the laws of probability (i.e., a function of the number of possible indicia to be drawn from and the number of possible indicia drawn and optionally, the order of the indicia drawn) and consequently are unable to accommodate all types of consumers with a single draw game.

The present invention thus eliminates this problem by allowing all consumers to "tune" a given, long shot, draw game to whatever odds and hit frequency they desire. For example, the largest possible odds for a game of Keno (typically, 80 choose 20 where all twenty numbers were correctly selected) is approximately 1 in 3.5 quintillion—1 in 3,535,316,142,212,174,336 to be exact. Therefore, with the existing prior art game of Keno, the possible wagers are limited to correctly selecting 0 to all 20 numbers with the corresponding odds fixed by the laws of probability; i.e.,

| Hits | Probability |
|---|---|
| 0 | 1 in 1,551 |
| 1 | 1 in 4 |
| 2 | 1 in 17 |
| 3 | 1 in 72 |
| 4 | 1 in 326 |
| 5 | 1 in 1,551 |
| 6 | 1 in 7,754 |
| 7 | 1 in 40,979 |
| 8 | 1 in 230,114 |
| 9 | 1 in 1,380,687 |
| 10 | 1 in 8,911,711 |
| 11 | 1 in 62,381,978 |
| 12 | 1 in 478,261,833 |
| 13 | 1 in 4,065,225,581 |
| 14 | 1 in 38,910,016,281 |
| 15 | 1 in 428,010,179,098 |
| 16 | 1 in 5,564,132,328,278 |
| 17 | 1 in 89,026,117,252,453 |
| 18 | 1 in 1,869,548,462,301,520 |
| 19 | 1 in 57,956,002,331,347,300 |
| 20 | 1 in 3,535,316,142,212,174,336 |

However, with the benefits inherent with the present invention, a draw game wager can be offered for virtually any odds and related payout for the same drawing so long as the produced odds are less than the largest possible odds for a game of Keno (i.e., 1 in 3,535,316,142,212,174,336). Consider the example wherein six different consumers desired the following six different odds for wagers:

1 in 10,000
1 in 100,000
1 in 1,000,000
1 in 10,000,000
1 in 100,000,000
1 in 1,000,000,000

If so, then a single universal Keno drawing event could support these six different odds by assigning six different numbers with associated moduli and creating six different sets of bin sizes to accommodate the desired odds, as follows:

| Odds Desired 1 in: | Bin Size |
|---|---|
| 10,000 | $3.53 * 10^{14}$ |
| 100,000 | $3.53 * 10^{13}$ |
| 1,000,000 | $3.53 * 10^{12}$ |
| 10,000,000 | $3.53 * 10^{11}$ |
| 100,000,000 | $3.53 * 10^{10}$ |
| 1,000,000,000 | $3.53 * 10^{9}$ |

Thus, with the present invention, any number of variable bets with differing payouts can be accommodated with a single universal drawing so long as the various bets feature odds are less than the largest possible odds inherent in the universal drawing. Additionally, a common rake or profit for all bets in the universal drawing can be maintained by preserving the same desired rake or profit percentage across all bets when calculating the payoff. The computational ease with which these calculations can be performed readily accommodates adoption by existing draw game systems, thereby providing variable fixed odds for all bets in real time.

Having concluded the discussion of an exemplarity prior art draw game execution, validation, and associated consumers, embodiments of the present invention will now be disclosed. As will be apparent to one skilled in the art, the present invention overcomes many of the inherent disadvantages of draw games, particularly enabling greater flexibility with consumer choices and play style.

Reference will now be made in detail to examples of the present invention, one or more embodiments of which are illustrated in the figures. Each example is provided by way of explanation of the invention, and not as a limitation of the invention. For instance, features illustrated or described with respect to one embodiment may be used with another embodiment to yield still a further embodiment. It is intended that the present application encompass these and other modifications and variations as come within the scope and spirit of the invention.

Preferred embodiments of the present invention may be implemented as methods, of which examples have been provided. The acts performed as part of the methods may be ordered in any suitable way. Accordingly, embodiments may be constructed in which acts are performed in an order different than illustrated, which may include performing some acts simultaneously, even though such acts are shown as being sequentially performed in illustrative embodiments.

Figure 1B:
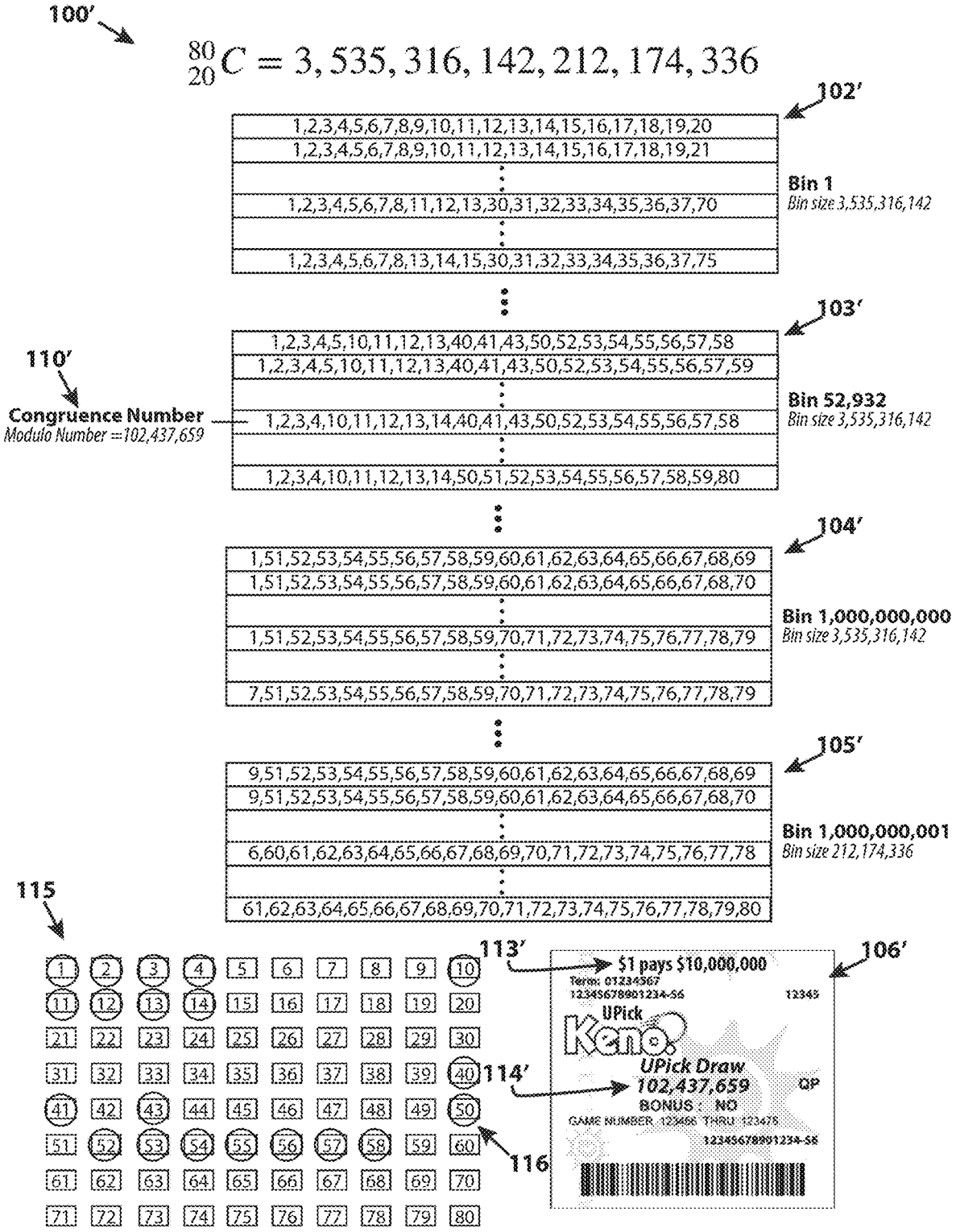
FIG. 1B is a representative example diagram defining the plurality bin and modulo number assignments at the time of redemption for a variable draw game system that is compatible with the representative example embodiment of FIG. 1A.

FIGS. 1A and 1B, taken together, illustrate one general embodiment describing the plurality bin and modulo number assignments for a variable draw game system. FIG. 1A illustrates the state of the system at the time a wager is made by a consumer while FIG. 1B illustrates the state of the same system at the time a consumer attempts a redemption.

In the exemplary system 100 of FIG. 1A the universal drawing event, from which the variable wager odds and corresponding prize payouts from the present invention are derived, will be from an exact "pick 20 from 80" typical Keno drawing 101, resulting in overall universal drawing odds of "1 in 3,535,316,142,212,174,336." From this one overall drawing 101 to be held in the future, this exemplary system 100 is shown to produce a draw game ticket 106 documenting a wager where the consumer has selected odds with a winning prize payout valued at "$1 pays $10,000,000" 113 resulting in the generation of a billion virtual bins with each bin holding a series of "3,535,316,142" (102 through 104) sequential drawing number outcomes with each specific outcome functioning as a "congruence number" for a given modulo number (e.g., 107 through 111)—i.e., each virtual bin contains a unique sequential series of "3,535,316,142" congruence numbers. However, the odds and payout selected by the consumer 113 (i.e., "$1 pays $10,000,000") necessitates an additional remainder bin 105, containing less than "3,535,316,142" sequential drawing number outcomes (i.e., congruence numbers), to be created that holds the remaining "212,174,336" series of sequential drawing or congruence number outcomes. The totality of all the bins (i.e., the billion bins—102 through 104—each sized "3,535,316,142" and the single remainder bin—105—sized "212,174,336") thereby providing a complete listing of all possible outcomes "3,535,316,142,212,174,336" of the exemplary "pick 20 from 80" Keno universal drawing event 101.

Thus, for the single $1 wager, the consumer has effectively selected or "quick picked" one billion and one drawing outcomes, a single outcome from each bin with a single modulo number 114 (i.e., "102,437,659"). Traditionally this type of odds division was viewed as impractical—i.e., how can a consumer possess a ticket listing one billion and one drawing outcomes; or more to the point, how can a consumer verify that he or she has won a drawing from one billion and one wagers? However, with the modulo pointer innovation of the present disclosure the totality of the consumer's one billion and one wagers can be reduced to a single modulo number 114 (i.e., "102,437,659"). The modulo number 114 simply designating a specified location to a single congruence number (and thereby corresponding draw number wager) in each of the bins. The modulo nature of the pointer number 114 allows the pointer to essentially roll over from the end to the beginning of the bin if the modulo number exceeds the size of the bin. Consequently, there can be only one congruence (draw) number outcome selected per bin.

FIG. 1B illustrates 100' the same exemplary universal drawing event 100 of FIG. 1A. However, FIG. 1B illustrates the state of the same system at the time the consumer that purchased the wager attempts to determine if he or she has won a prize. The outcome of the universal drawing event 115 (i.e., "pick 20 from 80" typical Keno drawing) is illustrated with the winning numbers highlighted with circles (e.g., 116), the winning sequence in this example being the twenty numbers: "1, 2, 3, 4, 10, 11, 12, 13, 14, 40, 41, 43, 50, 52, 53, 54, 55, 56, 57, and 58." Therefore, to determine if the exemplary consumer's ticket 106' has won the wager (i.e., "$1 pays $10,000,000") 113', the ticket's modulo number 114' is used to provide a pointer to a single congruence (draw) number within each of the one billion and one virtual bins (102' through 105'). If one of the one billion and one corresponding congruence numbers is the winning sequence of draw numbers 115, the consumer wins "$10,000,000," otherwise the consumer loses this particular drawing. In this particular example 100', the modulo number 110' points in bin 103' to the single winning congruence number sequence 110'—i.e., "1, 2, 3, 4, 10, 11, 12, 13,14, 40, 41, 43, 50, 52, 53, 54, 55, 56, 57, and 58." Thus, in this example, the consumer's ticket 106' with the nine digit modulo number 114' ("102,437,659") is in fact a winner, with the winning modulo number "102,437,659" 114' for any wager of "$1 pays $10,000,000" 113' publicly announced and posted such that the consumer can easily determine if he or she has won.

As is apparent to one skilled in the art, the present disclosure overcomes many of the inherent disadvantages of draw games, particularly designing a draw game that is appealing to a broad spectrum of consumers (e.g., "grind," "punters," "discovery," "jackpot"). Of course, as would be apparent to one skilled in the art in view of this disclosure, alternate embodiments of the present invention (e.g., pseudorandom distribution of the potential draw numbers throughout the bins, offering only a fixed number of predefined odds and payouts for the consumer to wager, offering parimutuel payouts for varying odds, promotional overlay games), etc. may under some circumstances be more desirable.

In an alternative embodiment, the variable and flexible draw game system is configured to provide a flexible progressive type wagering opportunity where the plurality of virtual bins remains static over a plurality of universal drawings. Thus, subsets of matching numbers or other indicia from the plurality of universal drawings can be specified (e.g., match fifteen) such that once a predetermined threshold of matching number subsets is achieved for an individual consumer, a prize is awarded. Since there will be an uncertain number of universal drawing iterations until the prize is awarded, the progressive jackpot will increase each time a universal drawing is played with the jackpot not won. When the progressive jackpot is won, the jackpot for the next play is reset to a predetermined value, and resumes increasing under the same method.

For example, a progressive jackpot could be offered across multiple universal drawings where the progressive prize is awarded when "19 out of 20" numbers were correctly selected by a consumer's modulo number with odds of "1" in "3,002,400" per drawing. The same generation of a billion virtual bins (102 through 104) of 100 of FIG. 1A with each bin holding a set of "3,535,316,142" sequential drawing number outcomes or "congruence numbers" plus the additional remainder bin 105 holding the remaining "212,174,336" set of congruence numbers could be employed for a progressive "19 out of 20" numbers match with the consumer's modulo number 114 (e.g., "102,437,659") and bins remaining static across the plurality of universal drawings until the progressive jackpot is won.

Figures 1, 2A:
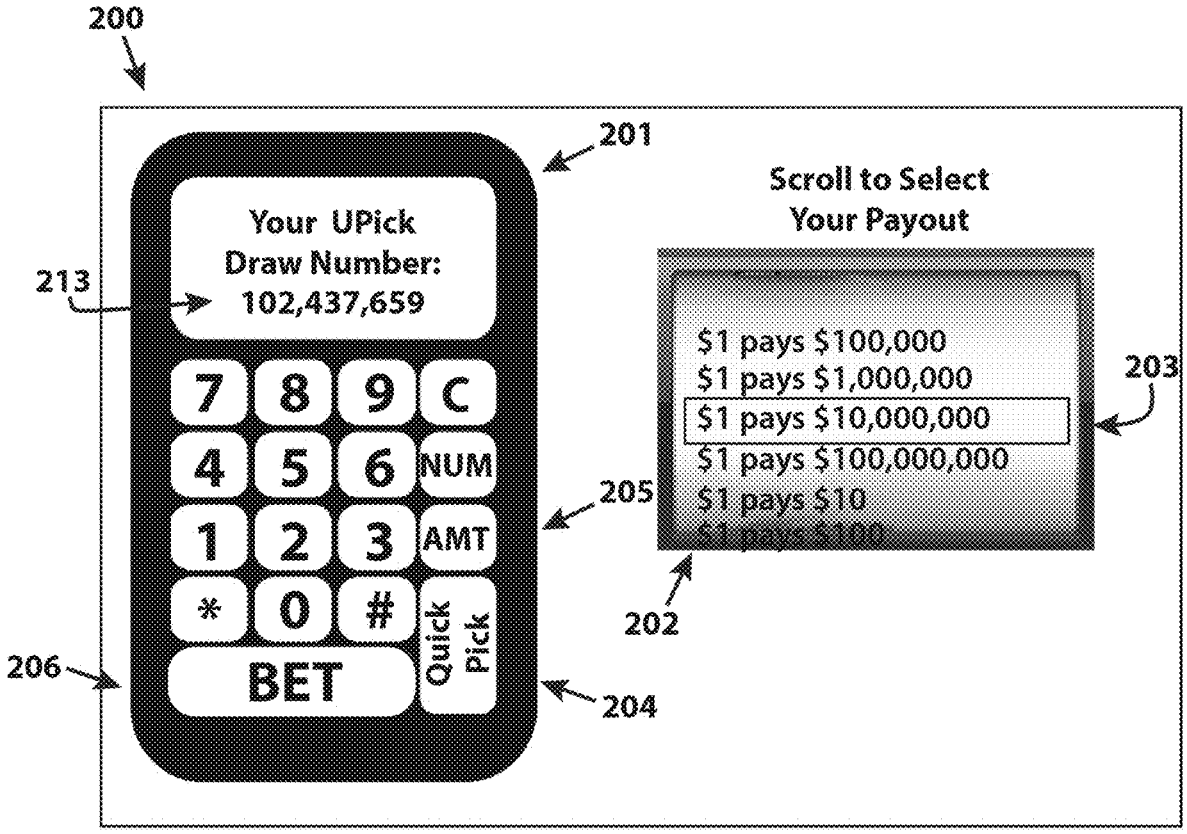
FIG. 2A-1 is a front elevation representative example of a variable draw game betting human interface where the consumer selects the payout that is compatible with the present invention.
Figures 2, 2A:
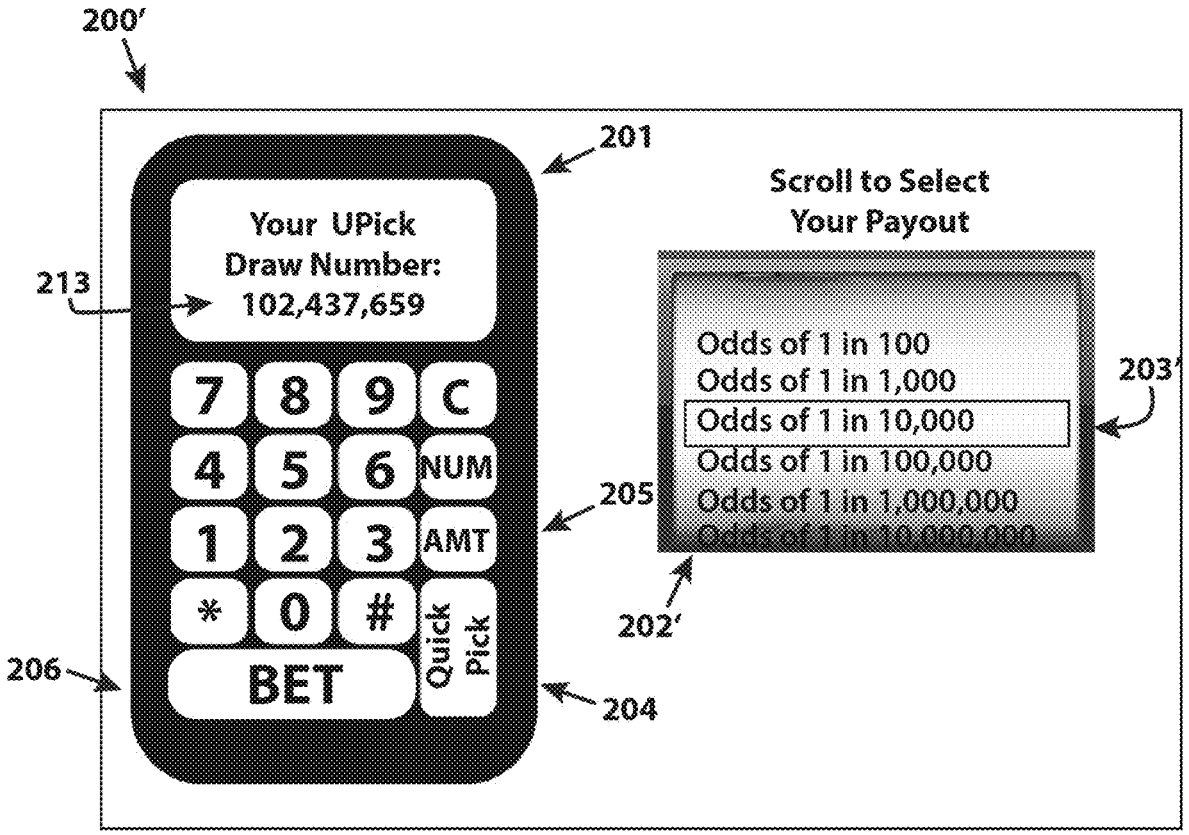

FIGS. 2A-1 and 2A-2 illustrate front elevation representative examples 200 and 200' of variable draw game betting human interfaces that are compatible with the embodiment of FIGS. 1A and 1B. As shown in FIGS. 2A-1 and 2A-2, there are two primary user interfaces inherent in variable and flexible draw game systems, namely, the keypad interface 201 where a consumer selects his or her modulo number and specifies the amount of the wager and optionally manually enters desired odds or payouts, and bin generation interface 202 and 202' where the consumer selects the payout 203 or odds 203' he or she wants to wager, which consequently determines the total number of virtual bins to be generated.

Typically, the consumer would first select their desired odds or payout via the virtual scroll wheel 202 and 202' as illustrated in these examples. Thus, in this example, the consumer would scroll through the wheel until the desired odds 203' or payout 203 was selected. At this point, the consumer would next select an "UPick Draw Number" (modulo number) 213 via "Quick Pick" 204 or manually keypad entry. While it is theoretically possible to accommodate virtually any "UPick Draw Number" 213, in a preferred embodiment, a range of possible "UPick Draw Numbers" may be displayed to aid the consumer in the selection process. Returning to the consumer selection process, after the consumer selects their "UPick Draw Number" (modulo number) 213 via manual key entry or "Quick Pick" 204, the consumer would typically be prompted to enter an amount to be wagered (e.g., $1 bet, $5 bet). This entered bet amount could be in response to a prompt or initiated by the consumer by actuating the "AMT" button 205. Once the: odds and corresponding payout 203, "UPick Draw Number" (modulo number) 213, and wager amount are selected; the consumer would typically finalize the wager by actuating the "BET" button 206 and then tendering a payment for the wager (not shown in FIG. 2A).

Of course, as is apparent to one skilled in the art, there are numerous variations on the exemplary user interface 200—e.g., the consumer could elect to select their "UPick Draw Number", or modulo number 213 before selecting the desired odds or payout was selected 203, the odds and pay out may be presented a priori to the consumer with the consumer only selecting the UPick Draw Number" or modulo number 213, or the consumer key entries (via 206) his or her desired odds or payout—that may under some circumstances be more desirable.

Figure 2B:
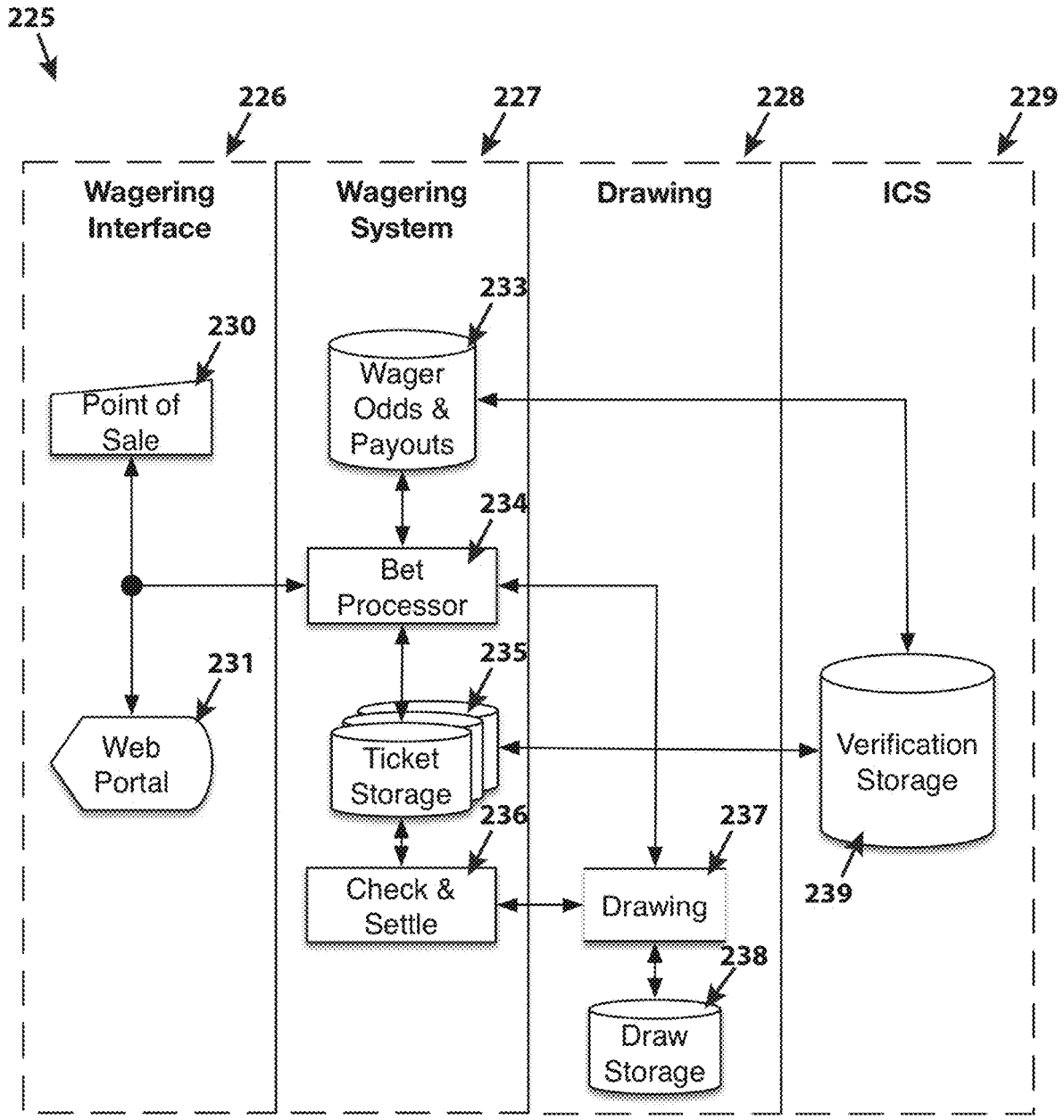
FIG. 2B is an overall swim lane flowchart representative example of the processes associated with issuing and redeeming a draw game ticket compatible with the specific embodiments of FIGS. 2A-1 and 2A-2.

As shown in the high-level architecture swim lane diagram 225 of FIG. 2B, there are four functional components (i.e., Wagering Interface 226, Wager System 227, Drawing 228, and Internal Control System or "ICS" 229) of the present invention. The Wagering Interface 226 (i.e., Point Of Sale or "POS" 230 and Web Portal 231) provides the transaction portal(s) that interact with specific consumers and/or operational staff, thereby enabling wagers or bets to be sold. All wagers or bets entered by the Wagering Interface 226 are passed to the Wagering System's 227 Bet Processor 234.

The Bet Processor 234 receives the proposed bet and if the requested odds or payout (e.g., 113 of FIG. 1A, 203 of FIG. 2A) is unique (i.e., the first time this specific odds or payout is requested for the pending universal drawing event 100 of FIG. 1A), then the Bet Processor 234 (FIG. 2B) will calculate the required number of bins and log the resulting calculated bin and congruence number segments into non-volatile Wager Odds & Payouts memory database 233. Once the calculated bin and congruence number segments are recorded, the pending bet selected modulo number is logged into non-volatile Ticket Storage memory 235 along with the associated requested odds or payout, thereby initiating a record of the pending bet. The remaining of bet processing is conducted in the normal (prior art) manner, with the bet assigned a unique serial number also logged into non-volatile Ticket Storage memory 235 with an acknowledgement ticket sent back to the Wagering Interface 226 device (230 or 231) that initiated the bet request, thereby documenting the bet. Typically, a hardcopy payable on demand ticket (e.g., 106 of FIG. 1A) is printed. Alternatively, or in addition to, a digital embodiment of the ticket may also be saved in a consumer's account or mobile device (e.g., smart phone).

Returning to the Bet Processor 234 (FIG. 2B) when it initially receives a bet, if a proposed bet's requested odds or payout is not unique (i.e., a previous bet has been logged on the Wager Odds & Payouts memory database 233 requesting the same odds) then the Bet Processor 234 will proceed as before, logging the pending bet selected modulo number into non-volatile Ticket Storage memory 235 along with the associated requested odds or payout, thereby initiating a record of the pending bet. As before, the remaining of bet processing is conducted in the normal (prior art) manner, with the bet assigned a unique serial number also logged into non-volatile Ticket Storage memory 235 with an acknowledgement ticket sent back to the Wagering Interface 226 device (230 or 231) that initiated the bet request, thereby documenting the bet.

Typically, on prior art systems, in addition to a Wagering System 227 there is also an Internal Control System ("ICS") 229 that functions as a non-volatile mirror Verification Storage database 239 to all Ticket Storage 235 bets recorded. Normally, the Verification Storage database 239 operates as a "Worm" (Write Once Read Many times) drive thereby ensuring that a robust audit trail is maintained for all bets. However, with the advent of the present disclosure, the ICS 229 should preferably be configured to also mirror the Wager Odds & Payouts database 223 into Verification Storage 239 in addition to the normal (prior art) Ticket Storage 235 such that a complete audit trail of all potential winning tickets can be maintained.

After the betting or wager period for a pending drawing is closed, a Drawing 237 determining the winning numbers or indicia for the universal drawing event (100 of FIG. 1A) is conducted, with the drawing results recorded in non-volatile Draw Storage 238 (FIG. 2B) that typically functions as a "Worm" drive. These drawing results are also passed from the Drawing 237 process to the Wagering System's 227 Check and Settle 236 process. Any apparent winning draw game tickets presented for redemption (e.g., 106' of FIG. 1B) to the Wagering System 227 are passed to the Check & Settle 236 service for validation and payment authorization. The Check & Settle 236 service then queries the Ticket Storage 235 database to determine if the bet was valid and if so, to ascertain the "UPick Draw Number" modulo number (e.g., 114' of FIG. 1B) as well as the associated odds or payout (e.g., 113' of FIG. 1B). At this point, the Check & Settle 236 (FIG. 2B) service queries the Wager Odds & Payouts database 233 to retrieve the bin and congruence number segments for the accompanying bet and then applies the bet's chosen modulo "UPick Draw Number" number to the various bins to determine if one of the congruence numbers (e.g., 110' of FIG. 1B) from the multiplicity of bins agrees with the universal drawing results (100' of FIG. 1B). If an exact match between one of the congruence numbers and the universal drawing result is determined, the draw game ticket (e.g., 106' of FIG. 1B) is declared a winner with the prize awarded, otherwise the ticket is declared a non-winner with no prize paid out.

Figure 3:
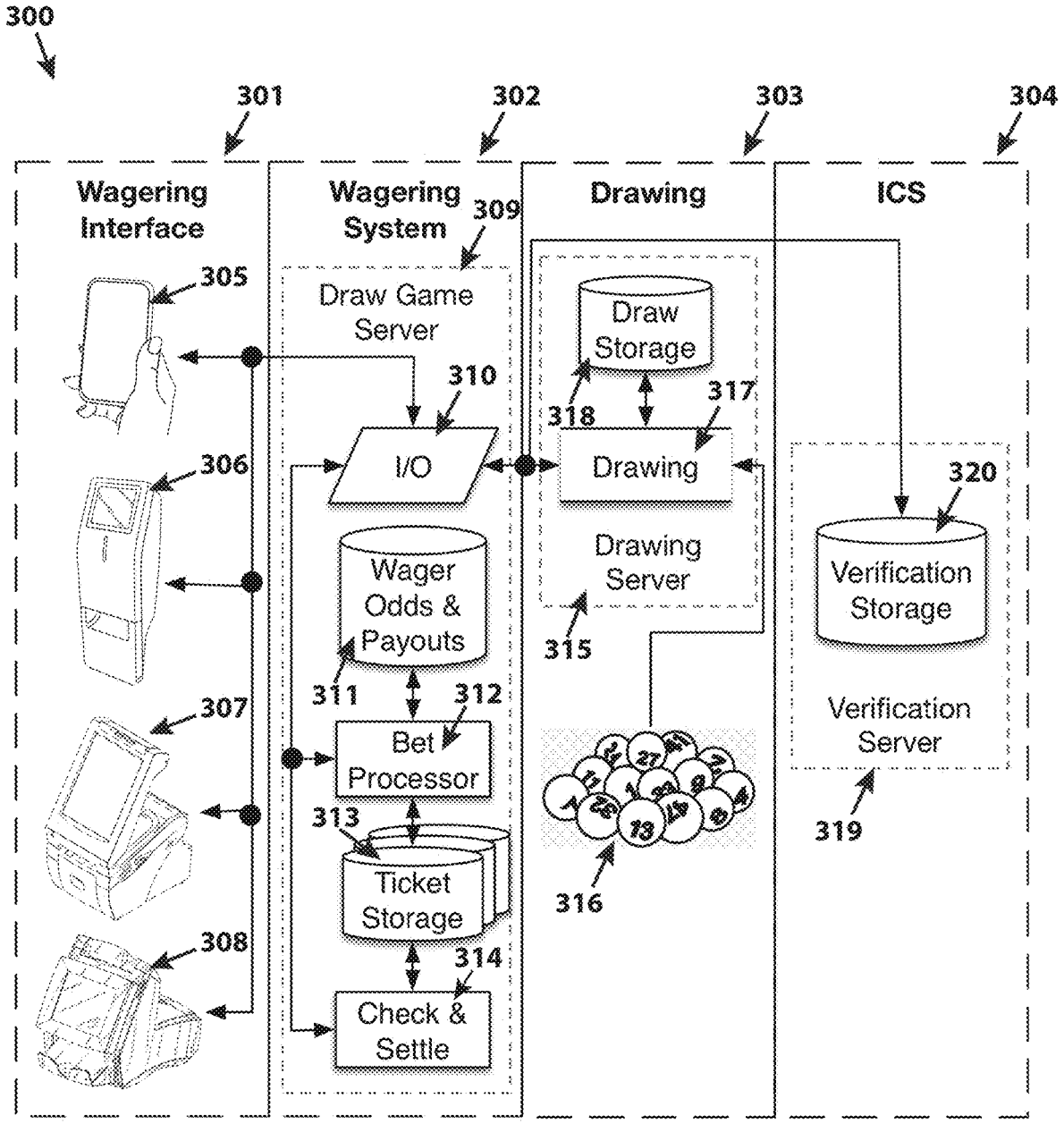
FIG. 3 is a representative example swim lane hardware block diagram of a draw game system embodiment as enabled by the present invention.

The related FIG. 3 swim lane system hardware architecture diagram 300 is also comprised of four functional components (i.e., Wagering Interface 301, Wager System 302, Drawing 303, and ICS 304) of the present invention, typically residing in separate devices or computing devices. The Wagering Interface 301 (e.g., hand held consumer device 305, kiosk 306, or retailer operated terminals 307 and 308) provides the transaction portal(s) that interact with specific consumers and/or operational staff, thereby enabling wagers or bets to be sold and redeemed. All wagers or bets received by the Wagering Interface 301 are passed to the Wagering System's 302 Draw Game Server 309 for processing, recording, and validation with the ICS 304 Verification Server 319 maintaining a mirror Ticket Storage 313 database on its Verification Storage 320 database.

As before, FIG. 3 begins with the Wagering Interface 301 providing the transaction portals (e.g., hand held consumer device 305, kiosk 306, or retailer operated terminals 307 and 308) that interact with specific consumers and/or operational staff, thereby enabling wagers or bets to be sold. All wagers or bets received by the Wagering Interface 301 are passed to the Wagering System's 302 Draw Game Server's 309 Bet Processor 312 service via one of its Input/Output (I/O) portals 310. The Bet Processor 312 receives the proposed bet and if the requested odds or payout is unique, then the Bet Processor 312 will calculate the required number of bins and log the resulting calculated bin and congruence number segments into non-volatile Wager Odds & Payouts memory database 311 with a copy also transferred via I/O 310 to the Verification Server's 319 Verification Storage 320 database. Once the calculated bin and congruence number segments are recorded, the pending bet would be processed as previously described with the bet assigned a unique serial number and logged along with the associated modulo number into non-volatile Ticket Storage memory 313. An acknowledgement is then sent back to the Wagering Interface 301 device (305 through 308) that initiated the bet request. Alternatively, if a proposed bet's requested odds or payout is not unique (i.e., a previous bet has been logged requesting the same odds) then the Bet Processor 312 simply processes the pending bet in the previously described fashion.

After the betting or wager period for a pending drawing is closed, a drawing (e.g., ping pong ball selection 316) determining the winning numbers or indicia for the universal drawing event is conducted, with the drawing results entered into the Draw Server's 315 Drawing 317 process with the results also recorded in non-volatile Draw Storage 318. These drawing results are also passed from the Drawing 317 process to the Wagering System's 302 Check and Settle 314 process. Any apparent winning draw game tickets presented for redemption to the Wagering System 301 are passed to the Check & Settle 314 service for validation and payment authorization. The Check & Settle 314 service then queries the Ticket Storage 313 database to determine if the bet was valid and if so, to ascertain the modulo "UPick Draw Number" as well as the associated odds or payout. At this point, the Check & Settle 314 service queries the Wager Odds & Payouts database 311 to retrieve the bin and congruence number segments for the accompanying bet and then applies the bet's chosen modulo "UPick Draw Number" number to the various bins to determine if one of the congruence numbers from the multiplicity of bins agrees with the universal drawing results. If an exact match between one of the congruence numbers and the universal drawing result is determined, the draw game ticket is declared a winner with the prize awarded, otherwise the ticket is declared a non-winner with no prize paid out.

Figure 4:
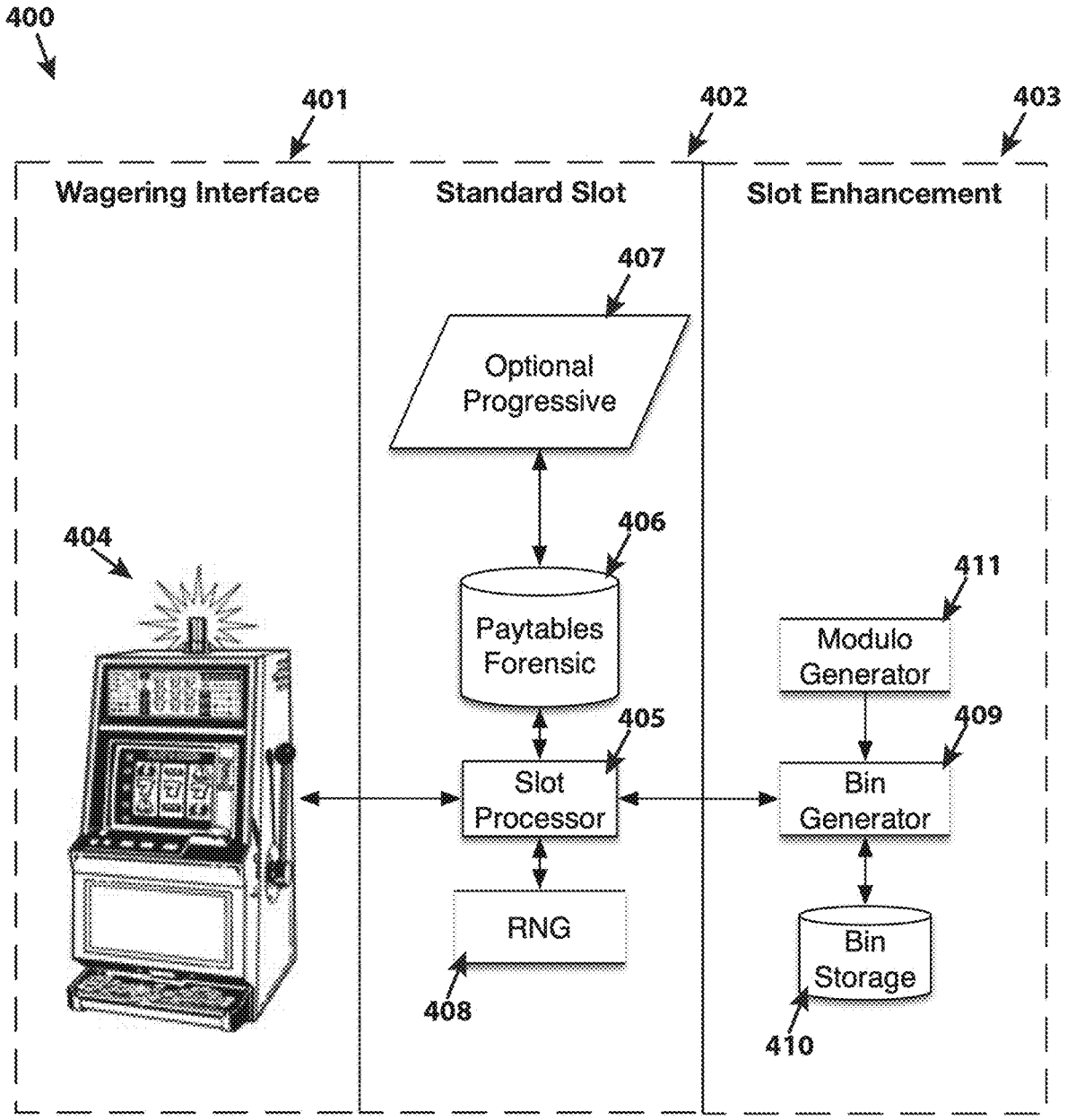
FIG. 4 is a representative example swim lane hardware block diagram of a draw game slot system embodiment as enabled by the present invention.

The FIG. 4 swim lane system hardware architecture diagram 400 provides an illustration of one possible alternative embodiment where the flexible draw game system utilizing computer hardware is employed in a slot machine 404. As illustrated in FIG. 4, this embodiment is comprised of three functional components (i.e., Wagering Interface 401, Standard Slot 402, and Slot Enhancement 403). The Wagering Interface 401 (e.g., floor cabinet slot machine 404) provides the transaction portal that interacts with specific consumers, thereby enabling wagers or bets to be sold. All wagers or bets received by the Wagering Interface 401 are passed to the Standard Slot's 402 Slot Processor 405, which is typically housed within the slot machine's 404 cabinet. As part of the Standard Slot's 402 normal operational services, a pay table database 406 is maintained for all standard (prior art) bets as well as typically functioning as a forensic database log of all bets and outcomes. Typically, for each bet, a Random Number Generator (RNG) 408 determines the win or lose outcome in accordance with the constraints as specified by the pay table database 406. The standard slot 402 functionality can also include an Optional Progressive 407 external interface to other slots or a to central site, thereby allowing portions of each bet to be allocated to a grand prize.

With the Enhancements 403 enabled by the present disclosure, the Standard Slot 402 is expanded to include flexible draw game functionality. As shown, this Slot Enhancement 403 functionality is comprised of a Bin Generator 409 and associated non-volatile Bin Storage 410 database memory. With this embodiment, if a consumer elects to enable flexible draw game functionality (or alternatively, internal logic of slot 404 determines to implement flexible draw game functionality where the odds or payout is selected by the internal logic transparent to the consumer), the pending bet and requested odds or payout are passed to the Bin Generator 409. If the requested odds or payout are unique, then the Bin Generator 409 will calculate the required number of bins and log the resulting calculated bin and congruence numbers segments into non-volatile Bin Storage memory database 410. Otherwise, if a proposed bet's requested odds or payout is not unique then the Bin Generator 409 simply references existing bin and congruence numbers segments from its Bin Storage 410 database. When the Bin Generator 409 is first contacted by the Slot Processor 405 it also requests and receives a unique modulo number from the Modulo Generator 411 for each bet request.

Once the modulo number, calculated bin, and congruence number segments are recorded, the pending bet would be processed by the RNG 408 generating a universal drawing result. If an exact match between one of the congruence numbers associated with the modulo number and the universal drawing result is determined, the bet wins and the prize is awarded.

FIG. 5 is a flowchart of one preferred embodiment of the present invention for enabling betting and redemption of draw game tickets with a plurality of different wager odds or payouts from a plurality of individual wagers made by consumers for one universal draw game to achieve a priori odds and a corresponding payout for an individual wager in the one universal draw game, using: (i) a plurality of n number of virtual bins that subdivide the largest possible odds of a universal draw game into a plurality of discrete bins of at least one size for each bin, each virtual bin being populated with a series of different congruence numbers representing a subset of all possible outcomes of the one universal draw game; and (ii) a modulo number, wherein the modulo number corresponds to a data pointer in n number of virtual bins such that the modulo number designates a single congruence number in each bin, the universal draw game having a draw game result. In one preferred embodiment, the following steps are performed:

STEP 500: Create, using a wagering system's bet processor, the n number of virtual bins of at least one size to be mathematically compatible with the odds or payouts, such that (i) each virtual bin contains a plurality of congruence numbers with each congruence number representing a different outcome from the plurality of possible outcomes of the universal draw game, and (ii)

the totality of all virtual bins contains congruence numbers for all possible outcomes of the universal draw game.

STEP 502: Generate, using the wagering system's bet processor, the corresponding modulo number such that there is one unique modulo pointer position in each of the n virtual bins.

STEP 504: Save the n number of virtual bins and congruence numbers into non-volatile memory on a draw game system central site database.

STEP 506: Record in the wagering system's bet processor consumer selections of desired odds or payouts for universal draw game tickets purchased by the consumers, the consumer selection of odds or payouts being made when the universal draw game tickets are purchased. The desired odds or payout may be selected from a predetermined set of odds or payouts, or may be selected from a range of odds or payouts.

STEP 508: Assign unique serial numbers to the purchased universal draw game tickets by the wagering system's bet processor, and save into the non-volatile memory on the draw game system central site database (i) the unique serial numbers, (ii) the corresponding consumer selected odds or payouts, and (iii) associated modulo numbers.

STEP 510: After the universal draw game has been concluded, use a wagering system's check and settle processor to validate the purchased universal draw game tickets against the universal draw game result by:

(i) retrieving the n number of virtual bins and congruence numbers associated with any universal draw game tickets submitted for validation from the draw game system central site database memory;

(ii) retrieving the modulo number associated with a universal draw game ticket submitted for validation from the draw game system central site database;

(iii) applying the retrieved modulo number to each of the retrieved n number of virtual bins to derive a unique congruence number from each bin, and testing each derived unique congruence number to determine whether it matches the universal draw game result; and (iv) paying the consumer winnings consistent with the odds or payout for the ticket's wager when one of the retrieved congruence numbers matches the universal draw game result.

This is not to say that the utility of bin generation and storage is only confined to providing a plurality of different wager odds or payouts for a given draw game type. In an alternate specific embodiment, bin generation and storage can be utilized to provide a concise method of accepting, recording, and documenting large numbers of wagers from a common shared betting pool alliance where multiple consumers contribute to a general draw game pool fund with a large plurality of individual wagers made by the alliance at one time. The resulting series of multiple payable on demand bet tickets generated by these shared betting pool alliances is logistically problematic for both the lottery retailer as well as the alliance itself—for example, 603 of FIG. 6A illustrates multiple Powerball tickets documenting one hundred wagers, presumably made by a shared betting pool alliance.

Figure 6B:
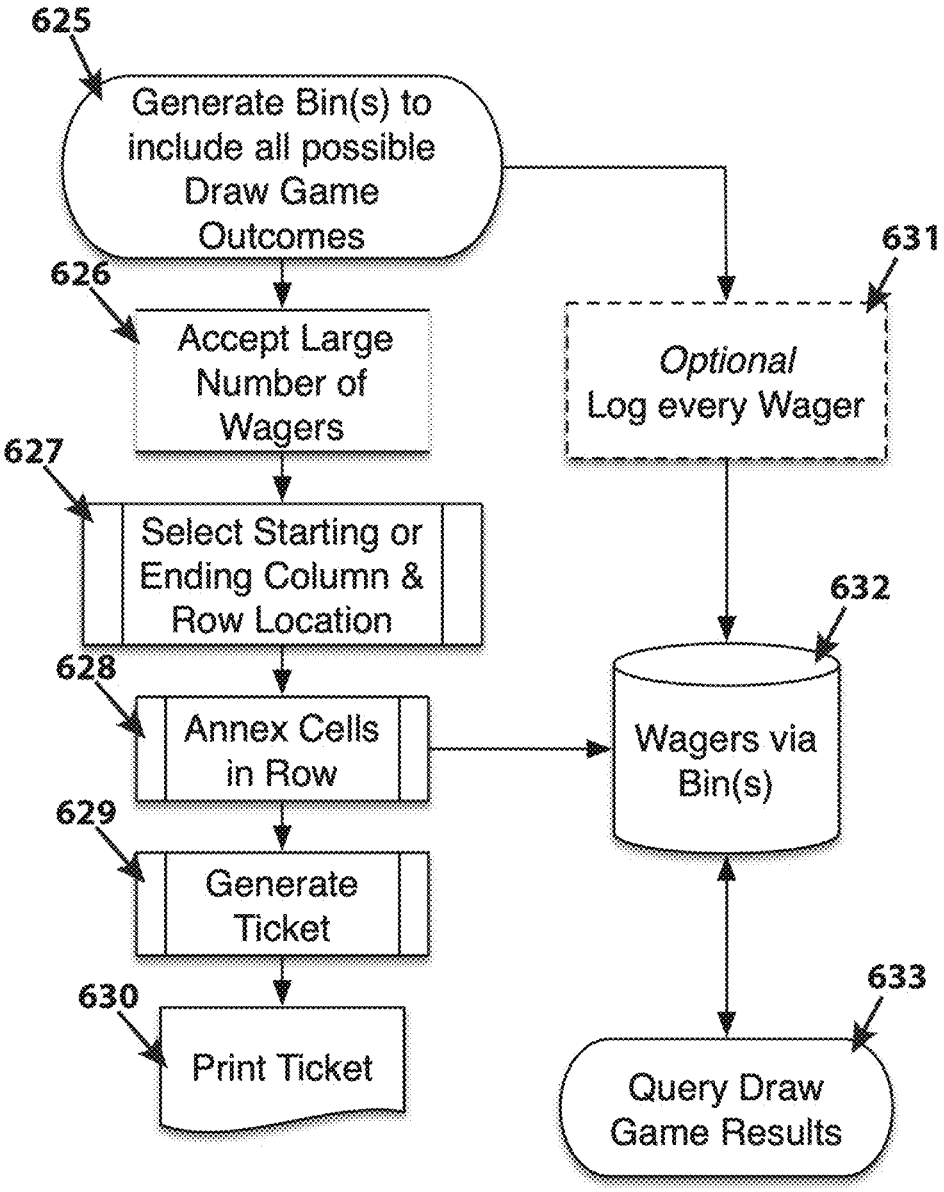
FIG. 6B is an overall flowchart representative example of the processes associated with issuing and redeeming a draw game ticket compatible with the specific embodiment of FIG. 6A.

FIGS. 6A and 6B, taken together, illustrate one general embodiment describing utilizing a bin assignment disclosure of an exemplary Powerball drawing. FIG. 6A illustrates an overall bin configuration for a typical Powerball drawing, including examples of identical wagers made by a presumably shared betting pool alliance in both prior art 603 and the disclosed embodiment 604. FIG. 6B illustrates the associated flowchart of the disclosed system that accepted, recorded, and documented the wager illustrated in 600 and 604 of FIG. 6A.

FIG. 6A symbolically represents a conceptual single bin 600 containing all possible outcomes for a typical Powerball drawing. While multiple bin construction is possible for both Powerball and Mega Millions games, since the total number of possible outcomes are both "pronic" or "rectangular" numbers (i.e., "292,201,338" and "302,585,350" respectively) the entire set of possible outcomes can be represented as a single bin for either game. Thus, for simplified explanatory purposes, only a single bin is discussed herein, with an understanding that multiple bin embodiments are also possible and may be more desirable under some circumstances.

As shown in FIG. 6A, all possible Powerball outcomes can be arranged in a single bin 600 cell matrix comprised of 897 columns by 12,529 rows with each cell holding a different congruence number. Each cell's congruence number of this single bin 600 matrix comprises one possible Powerball outcome with the column-1 row-1 cell 601 representing the numerically lowest possible outcome of "1, 5, 4, 3, 2, 1" with subsequent cells in each column congruence numbers incrementing by one from top to bottom (e.g., column-1 row-2 cell would represent the Powerball outcome "1, 5, 4, 3, 2, 2") also progressing from left to right culminating with the last cell 602 (i.e., column-897 row-12, 529) with the highest possible Powerball congruence number outcome of "26,69,68,67,66,65." In this example, the congruence number numerical arrangement of each cell within the single matrix bin 600 is the Powerball number (i.e., "1" to "26") inserted as the top most significant digit(s) with the associated five numbered white ball drawings (i.e., "1" to "69") following arranged with the highest numbered ball occupying the second most significant(s) digits down through the smallest numbered ball occupying the least significant digits(s). While the cell congruence numbers in the single matric bin 600 are illustrated (601 and 602) in a Comma-Separated Values (CSV) format, it should be noted that other formats (e.g., concatenated with each ball represented by two digits) are possible and may be more desirable in some embodiments.

With the embodiment of FIG. 6A, whenever a common shared betting pool alliance (where multiple consumers contribute to a general draw game pool fund) attempts to purchase a large plurality of quick pick wagers (e.g., one-hundred or more) the entire transaction can be documented by simply assigning a starting or ending cell location (e.g., "Row: 10,123 Column: 876" as illustrated in 604) with the number of bets or plays (e.g., "100") determining how many adjacent cells in the specified row will be annexed in the overall wager. In situations where the number of bets or plays exceeds a given row's capacity, the required number of additional cells are simply annexed from the next row starting from column-1. The intrinsic structure of the single matrix bin 600 creates a pseudorandom selection appearance by simply annexing adjacent cells in the same row for any large plurality of quick pick wagers. For quick pick wagers, the row and column starting or ending location may be selected by any of the well-known random or pseudorandom RNG systems; however, the embodiment could also support a consumer selected row and column starting or ending location. Regardless of the row and column selection process, with this embodiment the logistics of accepting, recording, and documenting large numbers of wagers are greatly simplified, both with digital processing as well as real world physical logistics—e.g., the exemplary comparison of one-hundred prior art Powerball bet tickets 603 verses a single Powerball bet ticket 604 as disclosed by this invention. This logistical simplification also extends to redeeming winning wagers where any consumer can simply type in the row, column, and number of plays on a lottery web site or application and instantly see all numbers wagered and whether any wagered numbers were winning combinations.

In an alternate embodiment, annexed or selected cells could also be flagged as "taken" such that subsequent wagers attempting to select the same cell would result in a digital blocking action or a warning to the consumer that at least one more bettor has selected this number. This alternate embodiment of flagging selected cells can be applied to all wagers for a particular game and not just shared betting pool alliances with large numbers of group bets. This is particularly desirable since the complexity of traditional lottery draw game systems inherently prohibit accessing draw game betting data in real time—i.e., the requirements to print bet tickets within a relatively short time period (e.g., less than three seconds) typically prohibit most types of real time data mining for fear of slowing bet processing and ticket printing. This prohibition of real time data mining other than cursory information (e.g., total number of tickets or bets sold) impacts potential features that could possibly increase sales. For example, most large draw games (e.g., Powerball, Mega Millions) are parimutuel in nature (i.e., where the pools of winnings are equally shared amongst all winners of a particular level) with the consequence of a large number of winners for any give drawing will result in each winner realizing a significantly reduced prize. Frequently, the most played numbers in Powerball are "01-11-21-31-41 with a Powerball of 09" because on many lottery Powerball bet slips coloring in these areas produces a diagonal line pattern. Additionally, on one occasion, one hundred and ten winning Powerball players all played white ball numbers "22-28-32-33-39" with a Powerball of "40" due to a collective fortune cookie prediction—i.e., each player making the "22-28-32-33-39 with a Powerball of 40" wager did so because of identical fortune cookie ticket recommendations. Thus, if it were possible to inform a player before making a bet that "X" number of players have already made this wager, the correspondingly decreased return on investment of a group of winners sharing a common prize fund would be flagged, potentially increasing sales. Now, with the innovation of bin representation of the set of all possible draw game wager outcomes, real time data mining can be easily implemented without significantly impacting the wagering process.

FIG. 6B illustrates the associated flowchart of the disclosed system that accepted, recorded, and documented the wager illustrated in 600 and 604 of FIG. 6A. The flowchart of FIG. 6B starts with utilizing a processor at the draw game central site to generate and save in a non-volatile database 632 memory the virtual bin(s) 625 with the correct number of cells to hold the entire set of possible outcomes for a given draw game. The exact specification for the virtual bin(s) 625 generated will vary depending on the draw game to be represented e.g., Powerball would require bin(s) with exactly "292,201,338" cells, Mega Millions would require exactly "302,585,350" cells, Pick 3 would require "1,000" cells, Pick 4 would require "10,000" cells.

Once the appropriate virtual bin(s) have been generated 625, the system would be available to accept wagers 626 particularly shared betting pool alliances with large sets of bet or play transactions. The overall wager for the entire set or pool of transactions are then assigned 627 a starting or ending cell location (e.g., "Row: 10,123 Column: 876" as illustrated in 604 of FIG. 6A) with the number of bets or plays (e.g., "100") determining how many adjacent cells in the specified row will be annexed in the overall wager 628 (FIG. 6B)—i.e., the number of individual bets or numbers wagered. In situations where the number of bets or numbers exceeds a given row's capacity, the required number of additional cells are simply annexed from the next row starting from column-1. For quick pick wagers, the row and column starting or ending location may be selected by any of the well-known random or pseudorandom systems (e.g., Linear Congruential Generator or "LCG", Mersenne Twister, Hardware Random Number Generator or "HRNG"). Alternatively, the system could also accept, consumer selected row and column starting or ending locations. Regardless of the method of selecting the row and column starting or ending location, the shared betting pool alliance's wager is then recorded in the draw game's central site wager database 632 by simply logging the row and column starting or ending locations as well as the number of bets or plays. Next, a draw game ticket is either printed on the lottery terminal 630 (also, 604 of FIG. 6A) or digitally recorded on the consumer's device (e.g., smart phone, laptop computer) thereby providing the consumer or shared betting pool alliance with a single payable on demand document for a large plurality of wagers.

The consumer or shared betting pool alliance may at any time verify 633 (FIG. 6B) the exact numbers wagered for a given draw game by querying the virtual bin(s) database 632 with the single ticket's serial number or by entering the starting or ending row and column with the number of bets or plays through any lottery portal (e.g., lottery kiosk, smart phone App). As a preferred optional embodiment, all wagers may be logged 631 into the bin(s) database 632 thereby enabling data mining into the draw game's wagers in real time.

FIG. 7 is a flowchart of one preferred embodiment of the present invention, described above with respect to FIGS. 6A and 6B, for wagering using a single draw game ticket for a pending wager made by an individual consumer for a given draw game. (FIG. 7 shows an abbreviated description of each of the steps. The full explanation of each of the steps is provided in the text explanation below.) The pending wager includes a plurality of discrete wagers, and the given draw game has a plurality of possible outcomes. In one preferred embodiment, the following steps are performed:

STEP 700: Create a virtual bin having a size that is mathematically compatible with the given draw game. The virtual bin is populated with a series of different cells containing respective congruence numbers, each congruence number representing a different possible outcome of the given draw game. A total set of all of the congruence numbers represent all possible outcomes of the given draw game. The virtual bin includes row and column numbers which allow for specifying one cell location within the virtual bin. This step corresponds to 625 in FIG. 6B.

STEP 702: Save the virtual bin, and its cells and congruence numbers, into memory on a draw game system central site database. This step corresponds to part of 632 in FIG. 6B.

STEP 704: Select row and column numbers of the virtual bin that specifies:

(i) one cell location within the virtual bin for one of the plurality of discrete wagers made by the individual consumer for the given draw game, the one cell location having a specified row and column number, and (ii) additional cell locations within the virtual bin for the remaining discrete wagers made by the individual consumer for the given draw game, each of the additional cell locations having a respective specified row and column number. The additional cell locations are annexed from a number of adjacent cells in the same row corresponding to the number of remaining discrete wagers.

This step corresponds to 627 and 628 in FIG. 6B.

STEP 706: Record, in the memory on the draw game system central site database, the one cell location within the virtual bin and the additional cell locations within the virtual bin for the plurality of discrete wagers made by the individual consumer for the given draw game. This step corresponds to part of 632 in FIG. 6B.

STEP 708: Generate a single draw game ticket that documents the pending wager and which identifies the number of the plurality of discrete wagers, thereby finalizing the pending wager. The single draw game ticket includes a unique serial number that is linked to the recorded cell locations within the virtual bin for the plurality of discrete wagers made by the individual consumer for the given draw game. This step corresponds to 629 in FIG. 6B.

As also discussed above, the given draw game may be a multi-jurisdictional lottery game, such as Powerball or Mega Millions. The single draw game ticket may be a physical embodiment printed on paper, or it may be a digital embodiment maintained on a mobile or portable device of the individual consumer.

As also discussed above, the row and column number that specifies the one cell location may be selected by a random or pseudorandom number generator, either with or without repeats. This type of selection is the "quick pick" option. In an alternative embodiment, the individual consumer may select a single outcome for the given draw game via a user interface, and the consumer's selection is used to specify the one cell location and the number of additional cell locations that correspond to the number of remaining discrete wagers. In this embodiment, prior to generating the single draw game ticket for the individual consumer and thereby finalizing the pending wager, the virtual bin may be checked to determine whether a prior pending wager of a consumer for the same given draw game has been previously recorded for any of the same cell locations and respective congruence numbers that were specified for the individual consumer. If so, a warning may be presented to the consumer prior to finalizing the pending wager. The consumer is then allowed to cancel the pending wager via the user interface prior to finalizing, thereby allowing the individual consumer to select a different single outcome for the given draw game that potentially does not specify cell locations that were previously recorded for a prior pending wager of a consumer for the same given draw game. Alternatively, prior to generating the single draw game ticket for the individual consumer and thereby finalizing the pending wager, the virtual bin is checked to determine whether a prior pending wager of a consumer for the same given draw game has been previously recorded for any of the same cell locations and respective congruence numbers that were specified for the individual consumer. If so, the pending wager is automatically blocked or canceled prior to finalizing the pending wager. The consumer is then informed via the user interface that the pending wager was blocked or canceled, and that a different single outcome should be subsequently selected if the individual consumer desires to make another wager.

While there are advantages of the embodiment shown in FIGS. 6A and 6B anytime a consumer makes multiple discrete wagers (e.g., 2 or more) using a single draw game ticket, the advantages become much greater for consumers who make very large numbers of discrete wagers (e.g., 100 or more) using a single draw game ticket. In one preferred embodiment, when the number of additional cell locations that are required exceeds the capacity of the cells in the same row as the row of the one of the plurality of discrete wagers, more cell locations are annexed from a number of cells of one or more adjacent rows starting with the first column number in each respective adjacent row. This scenario is much more likely to occur when a consumer makes very large numbers of discrete wagers using a single draw game ticket.

A system for wagering using a single draw game ticket for a pending wager made by an individual consumer for a given draw game that implements the features and steps shown in FIGS. 6A, 6B and 7 may be constructed using the same physical computer elements shown in FIGS. 1A-5, including a wagering system bet processor, a draw game system central site database having a memory, and an RNG, and thus is not separately illustrated.

Regarding the embodiment of FIGS. 6A, 6B and 7, while the description above refers to "a virtual bin," it should be understood that multiple virtual bins may be used, and that the scope of "a virtual bin" includes singular and plural virtual bins. When plural virtual bins are used, the totality of the virtual bins contain congruence numbers for all possible outcomes of a given draw game. When only a single virtual bin is used, the single virtual bin contains congruence numbers for all possible outcomes of a given draw game.

It should be appreciated by those skilled in the art in view of this description that various modifications and variations may be made present invention without departing from the scope and spirit of the present invention. It is intended that the present invention include such modifications and variations as come within the scope of the appended claims.

What is claimed is:

1. A method for wagering using a single draw game ticket for a pending wager made by an individual consumer for a given draw game, the pending wager including a plurality of discrete wagers, the given draw game having a plurality of possible outcomes, the method comprising:

(a) creating a virtual bin having a size that is mathematically compatible with the given draw game, the virtual bin being populated with a series of different cells containing respective congruence numbers, each congruence number representing a different possible outcome of the given draw game, a total set of all of the congruence numbers representing all possible outcomes of the given draw game, the virtual bin including row and column numbers which allow for specifying one cell location within the virtual bin;

(b) saving the virtual bin, and its cells, and respective congruence numbers, into memory on a draw game system central site database;

(c) selecting row and column numbers of the virtual bin that specifies:

(i) one cell location within the virtual bin for one of the plurality of discrete wagers made by the individual consumer for the given draw game, the one cell location having a specified row and column number, and (ii) additional cell locations within the virtual bin for the remaining discrete wagers made by the individual consumer for the given draw game, each of the additional cell locations having a respective specified row and column number, and wherein the additional cell locations are annexed from a number of adjacent cells in the same row corresponding to the number of remaining discrete wagers;

(d) recording, in the memory on the draw game system central site database, the one cell location within the virtual bin and the additional cell locations within the virtual bin for the plurality of discrete wagers made by the individual consumer for the given draw game; and (e) generating a single draw game ticket that documents the pending wager and which identifies the number of the plurality of discrete wagers, thereby finalizing the pending wager, wherein the single draw game ticket includes a unique serial number that is linked to the recorded cell locations within the virtual bin for the plurality of discrete wagers made by the individual consumer for the given draw game.

2. The method of claim 1 where the row and column number that specifies the one cell location are selected by a random or pseudorandom number generator.

3. The method of claim 1 where the row and column number that specifies the one cell location are selected by a random or pseudorandom number generator in such a manner that avoids selection of the one cell location and any additional cell locations that were previously recorded as a result of a prior pending wager of a consumer for the same given draw game.

4. The method of claim 1 wherein the given draw game is a multi jurisdictional lottery game.

5. The method of claim 1 where the single draw game ticket is a physical embodiment printed on paper.

6. The method of claim 1 where the single draw game ticket is a digital embodiment maintained on a mobile or portable device of the individual consumer.

7. The method of claim 1 wherein the individual consumer selects a single outcome for the given draw game via a user interface, and the consumer's selection is used to specify the one cell location and the number of additional cell locations that correspond to the number of remaining discrete wagers, the method further comprising:

(f) prior to generating the single draw game ticket for the individual consumer and thereby finalizing the pending wager, checking the virtual bin to determine whether a prior pending wager of a consumer for the same given draw game has been previously recorded for any of the same cell locations and respective congruence numbers that were specified for the individual consumer, and, if so, presenting a warning to the consumer prior to finalizing the pending wager, and (g) allowing the individual consumer to cancel the pending wager via the user interface prior to finalizing, thereby allowing the individual consumer to select a different single outcome for the given draw game that potentially does not specify cell locations that were previously recorded for a prior pending wager of a consumer for the same given draw game.

8. The method of claim 1 wherein the individual consumer selects a single outcome for the given draw game via a user interface, and the consumer's selection is used to specify the one cell location and the number of additional cell locations that correspond to the number of remaining discrete wagers, the method further comprising:

(f) prior to generating the single draw game ticket for the individual consumer and thereby finalizing the pending wager, checking the virtual bin to determine whether a prior pending wager of a consumer for the same given draw game has been previously recorded for any of the same cell locations and respective congruence numbers that were specified for the individual consumer, and, if so, automatically blocking or canceling the pending wager prior to finalizing the pending wager, and (g) communicating to the individual consumer via the user interface that the pending wager was blocked or canceled, and that a different single outcome should be subsequently selected if the individual consumer desires to make another wager.

9. The method of claim 1 wherein when the number of additional cell locations that are required exceeds the capacity of the cells in the same row as the row of the one of the plurality of discrete wagers, more cell locations are annexed from a number of cells of one or more adjacent rows starting with the first column number in each respective adjacent row.

10. The method of claim 1 wherein the plurality of discrete wagers includes at least one-hundred wagers made by the individual consumer using the single draw game ticket.

11. A system for wagering using a single draw game ticket for a pending wager made by an individual consumer for a given draw game, the pending wager including a plurality of discrete wagers, the given draw game having a plurality of possible outcomes, the system comprising:

(a) a wagering system bet processor configured to:

(i) create a virtual bin having a size that is mathematically compatible with the given draw game, the virtual bin being populated with a series of different cells containing respective congruence numbers, each congruence number representing a different possible outcome of the given draw game, a total set of all of the congruence numbers representing all possible outcomes of the given draw game, the virtual bin including row and column numbers which allow for specifying one cell location within the virtual bin; and (b) a draw game system central site database having a memory, the draw game system central site database being configured to:

(i) save the virtual bin, and its cells, and respective congruence numbers, into the memory on the draw game system central site database;

wherein the wagering system bet processor is further configured to:

(ii) select row and column numbers of the virtual bin that specifies:

(A) one cell location within the virtual bin for one of the plurality of discrete wagers made by the individual consumer for the given draw game, the one cell location having a specified row and column number, and (B) additional cell locations within the virtual bin for the remaining discrete wagers made by the individual consumer for the given draw game, each of the additional cell locations having a respective specified row and column number, and wherein the additional cell locations are annexed from a number of adjacent cells in the same row corresponding to the number of remaining discrete wagers;

and wherein the draw game system central site database is further configured to:

(ii) record, in the memory on the draw game system central site database, the one cell location within the virtual bin and the additional cell locations within the virtual bin for the plurality of discrete wagers made by the individual consumer for the given draw game;

and wherein the wagering system bet processor is further configured to:

(iii) generate a single draw game ticket that documents the pending wager and which identifies the number of the plurality of discrete wagers, thereby finalizing the pending wager, wherein the single draw game ticket includes a unique serial number that is linked to the recorded cell locations within the virtual bin for the plurality of discrete wagers made by the individual consumer for the given draw game.

12. The system of claim 11 further comprising:

(c) a pseudorandom number generator configured to select the row and column number that specifies the one cell location.

13. The system of claim 11 further comprising:

(c) a pseudorandom number generator configured to select the row and column number that specifies the one cell location in such a manner that avoids selection of the one cell location and any additional cell locations that were previously recorded as a result of a prior pending wager of a consumer for the same given draw game.

14. The system of claim 11 wherein the given draw game is a multi jurisdictional lottery game.

15. The system of claim 11 where the single draw game ticket is a physical embodiment printed on paper.

16. The system of claim 11 where the single draw game ticket is a digital embodiment maintained on a mobile or portable device of the individual consumer.

17. The system of claim 11 wherein the individual consumer selects a single outcome for the given draw game via a user interface, and the consumer's selection is used to specify the one cell location and the number of additional cell locations that correspond to the number of remaining discrete wagers, wherein the wagering system bet processor is further configured to:

(iv) check the virtual bin, prior to generating the single draw game ticket for the individual consumer and thereby finalizing the pending wager, to determine whether a prior pending wager of a consumer for the same given draw game has been previously recorded for any of the same cell locations and respective congruence numbers that were specified for the individual consumer, and, if so, presenting a warning to the consumer prior to finalizing the pending wager, and (v) allow the individual consumer to cancel the pending wager via the user interface prior to finalizing, thereby allowing the individual consumer to select a different single outcome for the given draw game that potentially does not specify cell locations that were previously recorded for a prior pending wager of a consumer for the same given draw game.

18. The system of claim 11 wherein the individual consumer selects a single outcome for the given draw game via a user interface, and the consumer's selection is used to specify the one cell location and the number of additional cell locations that correspond to the number of remaining discrete wagers, wherein the wagering system bet processor is further configured to:

(iv) check the virtual bin, prior to generating the single draw game ticket for the individual consumer and thereby finalizing the pending wager, to determine whether a prior pending wager of a consumer for the same given draw game has been previously recorded for any of the same cell locations and respective congruence numbers that were specified for the individual consumer, and, if so, automatically blocking or canceling the pending wager prior to finalizing the pending wager, and (v) communicate to the individual consumer via the user interface that the pending wager was blocked or canceled, and that a different single outcome should be subsequently selected if the individual consumer desires to make another wager.

19. The system of claim 11 wherein when the number of additional cell locations that are required exceeds the capacity of the cells in the same row as the row of the one of the plurality of discrete wagers, more cell locations are annexed from a number of cells of one or more adjacent rows starting with the first column number in each respective adjacent row.

20. The system of claim 11 wherein the plurality of discrete wagers includes at least one-hundred wagers made by the individual consumer using the single draw game ticket.

* * * * *